US008707629B2

(12) United States Patent
Cuffe et al.

(10) Patent No.: US 8,707,629 B2
(45) Date of Patent: Apr. 29, 2014

(54) DISPOSABLE TRADESHOW BOOTHS

(75) Inventors: Robert A. Cuffe, Madison, AL (US); Robert W. Womack, Decatur, AL (US); Christopher M. Washco, legal representative, Decatur, AL (US); Clay A. Womack, legal representative, Gulf Shores, AL (US)

(73) Assignee: Disposable Exhibits LLC, Madison, AL (US)

( * ) Notice: Subject to any disclaimer, the term of this patent is extended or adjusted under 35 U.S.C. 154(b) by 40 days.

(21) Appl. No.: 13/003,574

(22) PCT Filed: Jul. 10, 2009

(86) PCT No.: PCT/US2009/050338
§ 371 (c)(1),
(2), (4) Date: May 23, 2011

(87) PCT Pub. No.: WO2010/006322
PCT Pub. Date: Jan. 14, 2010

(65) Prior Publication Data

US 2011/0289858 A1 Dec. 1, 2011

Related U.S. Application Data

(60) Provisional application No. 61/134,437, filed on Jul. 10, 2008.

(51) Int. Cl.
*A47F 10/00* (2006.01)

(52) U.S. Cl.
USPC ..... 52/36.1; 52/79.1; 52/79.5

(58) Field of Classification Search
USPC ..... 52/36.1, 79.1, 79.5, 36.5, 36.6; 40/610
See application file for complete search history.

(56) References Cited

U.S. PATENT DOCUMENTS

| | | | | |
|---|---|---|---|---|
| 3,394,525 | A | | 7/1968 | McKee |
| 4,176,480 | A | * | 12/1979 | Euzarraga et al. ..... 40/780 |
| 4,827,690 | A | | 5/1989 | Vigor |
| 6,718,669 | B1 | | 4/2004 | Hayes |
| 2003/0024189 | A1 | | 2/2003 | Hughes et al. |

FOREIGN PATENT DOCUMENTS

| | | |
|---|---|---|
| DE | 92 12 077 U1 | 11/1992 |

* cited by examiner

*Primary Examiner* — Basil Katcheves
(74) *Attorney, Agent, or Firm* — Mark Clodfelter

(57) ABSTRACT

A tradeshow booth is constructed of portions including structural members [10, 28, 44, 56, 56*a*, 72, 103]. Each of these portions are constructed of laminated cardboard or other similar easily recyclable material, Vertical L-shaped beam members [74] connect upper and lower structural members together to form portions of a tradeshow booth. The individual portions are in turn connected together using U-shaped connectors [68], and which may be locked in place by gussets [62]. A decorative or advertising display covering [90] covers the assembled portions. Significantly, the entire tradeshow booth is extremely lightweight and strong, and may be assembled entirely by hand without using tools of any kind.

15 Claims, 18 Drawing Sheets

DISPOSABLE TRADESHOW BOOTHS

CROSS REFERENCE TO RELATED APPLICATIONS

This application claims the benefit of U.S. provisional patent application No. 61/134,437, entitled "DISPOSABLE TRADESHOW BOOTH", filed Jul. 10, 2008, and which is incorporated herein by reference in its entirety.

FIELD OF THE INVENTION

This invention relates generally to tradeshow booths, and particularly to a tradeshow booth system that is particularly easy to transport, assemble, and disassemble and is constructed exclusively of lightweight materials that may be reused, disposed of or recycled after use.

BACKGROUND OF THE INVENTION

At a typical tradeshow, goods and services are advertised, and buyers of these goods and services have an opportunity to peruse the latest and greatest products from a variety of manufacturers. In order to promote such goods and services, manufacturers design and construct (or hire someone to design and construct) booths from which their representatives operate. These booths are typically made of frames constructed of wood or metal, or combinations thereof, and which may have laminated surfaces, plastic panels and paper, sheet plastic or fabric banners or other coverings upon which advertising matter is printed. Some tradeshow booths may even have a small room incorporated therein where buyers and sellers may converse in private, or where a potential buyer may arrange a private showing.

These tradeshow booths are heavy, being packed in shipping crates that weigh around 500 pounds each, and must be packed in shipping crates and shipped as freight by rail, truck or boat to an exhibition hall. As is currently the practice, an exhibitor arranges to ship or carry the display booth to the exhibit hall, where the display booth is assembled. After the tradeshow, the display booth is disassembled and packed back into its shipping crates and shipped to a place of storage, such as a warehouse, where the display booth is stored until its next use.

The cost of designing, fabricating and setting up and disassembling a conventional display booth at a tradeshow is expensive, with a typical booth costing $100,000 or more just for designing and fabricating the booth. In addition, cost of drayage and transporting and assembling the booth at the trade show may run another $30,000-40,000 or so. After the tradeshow is over, the booth must be disassembled and packed up, typically in shipping crates, and transported to a storage facility. This may cost another $20,000 or so. In addition, the cost of storage may be on the order of $0.25 per square or cubic foot per day. Where tools, such as wrenches, screwdrivers, hammers and the like are needed to assemble the booth, a state or city within which the exhibition is held typically would require that union labor be used, adding to the total cost.

"Point-of-purchase" displays may be constructed from cardboard, foam board or the like. Such displays typically are placed on countertops, although larger displays may be located on a floor surface. These displays usually will highlight or promote a product, usually held in some form of container or stacked on the display. Such displays have little structural integrity.

Yet another type of cardboard display includes cutouts or pop-up displays of famous figures that are typically used to promote a movie or product. While these may be freestanding displays, they have very little strength or structural integrity.

From the foregoing, it is apparent that there is a need for a trade show booth system that can construct a larger booth, that is easy to fabricate and transport, and which may be assembled at an exhibition hall without tools. It may also be easily packed up for transport after use, or simply discarded after removing the graphics covering. The cardboard structure can then be recycled by the convention facility, which is a standard industry process.

DETAILED DESCRIPTION OF THE DRAWINGS

Figure 1:
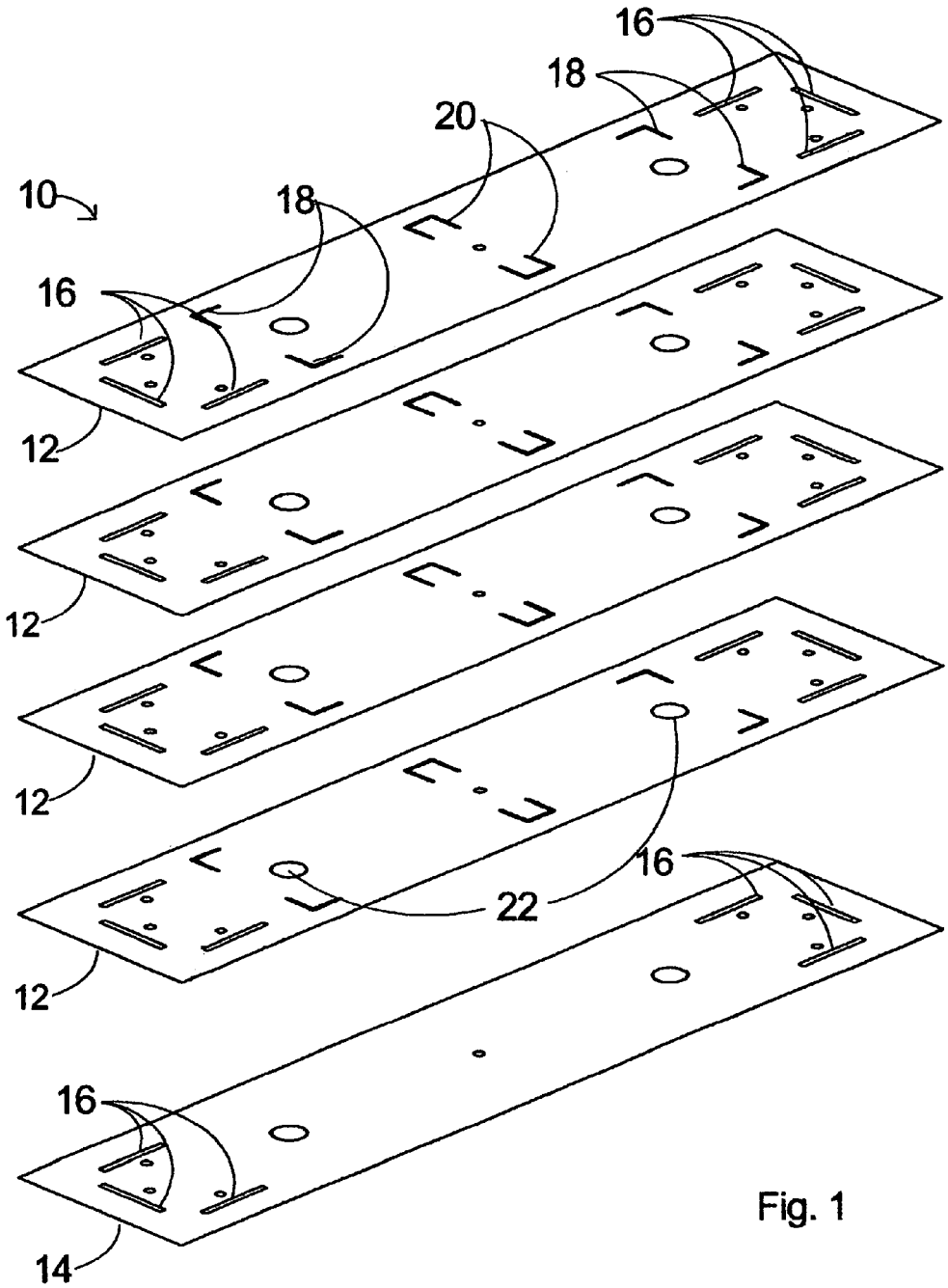
FIG. 1 illustrates construction details of a straight rectangular structural member of my new disposable display booth system.

In accordance with the instant invention, a tradeshow booth system, which includes ancillary components such as a reception podium or stand and decorative structures associated with the tradeshow booth but not directly connected to the booth, is provided. The booth itself and ancillary structures are fabricated from lightweight and easily worked and shaped materials, such as cardboard, foam board, other expanded plastics, fabric and/or sheet plastic, upon which a covering is attached for commercial display purposes. As will be explained, a tradeshow booth of the instant invention may be carried to an exhibition hall by one person and assembled by one person without the use of tools. Smaller tradeshow booths, such as booths having a footprint or floor space of 10 feet×10 feet, and which include all structural members, fabric panels and coverings, may be packed into 2 or 3 standard sized cardboard boxes sized to be easily hand-carried. By way of example, Applicant uses cardboard boxes of about 10"× 16"×45" for packing booths, each box being packed to generally weigh less than about 35 pounds or so. Larger booths, with a footprint of 20 feet by 30 feet or so, may require around 20 of such easily carried cardboard boxes. With this packing of the booths, the entire booth may be mailed using a parcel delivery service rather than shipping the booth as freight. Where smaller booths are used, such as the aforementioned 10 foot×10 foot booth, the cardboard boxes containing the entire booth may be placed in a small car and carried to the exhibition hall. In addition, Applicant's cardboard booths may be assembled without using equipment or tools typically used to set up display booths, such as forklifts, hand tools and other equipment. After the exhibition, at least the cardboard portions of the display booth may be discarded or recycled, eliminating a need for packing, return shipping and storage of the display booth. Certain other parts, possibly the fabric or plastic sheet display portions, may be packed and stored for reuse. However, since the fabric or sheet portions occupy little space, storage requirements for these components are greatly reduced. In other instances, the entire booth including all connectors and fabric, may be discarded or given up for recycling. As such, the entire booth is constructed of easily recyclable materials.

By way of example only, structural components, designated as assembly members, used to create a tradeshow booth or other structure are shown in FIGS. 1-6. These components are used to create discrete booth portions that are connectable together to form a frame-like structure having display regions over which decorative and advertising sheet material is mounted to create a finished appearance of the display booth. Portions of the frame or individual booth portions may be left open in order to mount televisions, monitors, backlit displays, literature racks and the like. In addition, some booth portions may be stacked and connected together to form a taller display.

Referring initially to FIG. 1, an exploded view of a first assembly plate 10 is shown that is used to form a rectangular, straight booth portion. This assembly plate can be made in a number different sizes but in this example the unit is about 37" long, 8" wide, and is 1.25" thick. Assembly plate 10 is fabricated of a nonmetallic, recyclable material such as cardboard, compressed and glued paper, foam board such as Styrofoam™, Corplast™, a lightweight or hollow plastic or other similar lightweight, strong material. As should be readily apparent, these materials are easily cut and formed, as by die cutting or stamping. Applicants have found that standard double walled E flute recyclable and recycled cardboard works well for the assembly plates and stiffening webs or diaphragms of his booth structures. Where such corrugated cardboard is used, several corrugated cardboard layers 12, which may be identical, are glued together using a water based repulpable glue to form strong, lightweight rectangular top and bottom assembly plates, as shown in FIGS. 1-3*b*. While 5 layers of corrugated cardboard are shown, more or fewer layers may be used, depending on the requirements of the booth or other application. In different embodiments, the corrugations in the layers may run in the same direction, or be oriented to run in different or alternating directions for even greater strength. The cardboard layers 12 each have sets of slots and cutouts as shown, with a set of straight slots 16 positioned as shown at each end, and a set of L-shaped slots 18 positioned inboard of slots 16. In some embodiments, a set of U-shaped slots 20 are provided generally in the center of layers 12, while in other embodiments positioning of slots 20 is selected such that there is equal spacing between slots 20 and slots 18, for reasons that will be further explained. As should be apparent, when layers 14 of cardboard are glued together to form assembly plate 10, the various corresponding slots 16, 18, 20 are in communicating relation in order to receive connecting members, as will be further described. Openings 22 are used to register and align the layers during fabrication, and which may be used to integrate cabling and wiring throughout the booth structure. Bottom or top plate 14 of cardboard is provided with sets of slots 16, while omitting sets of slots 18 and 20. Here, connecting beam members that pass through sets of slots 18, 20 and frictionally held in place are prevented from passing completely through assembly plate 10 by the absence of communicating slots 18, 20 in plate 14. Thus, plate 14 may be designated as a stop plate.

Figure 1A:
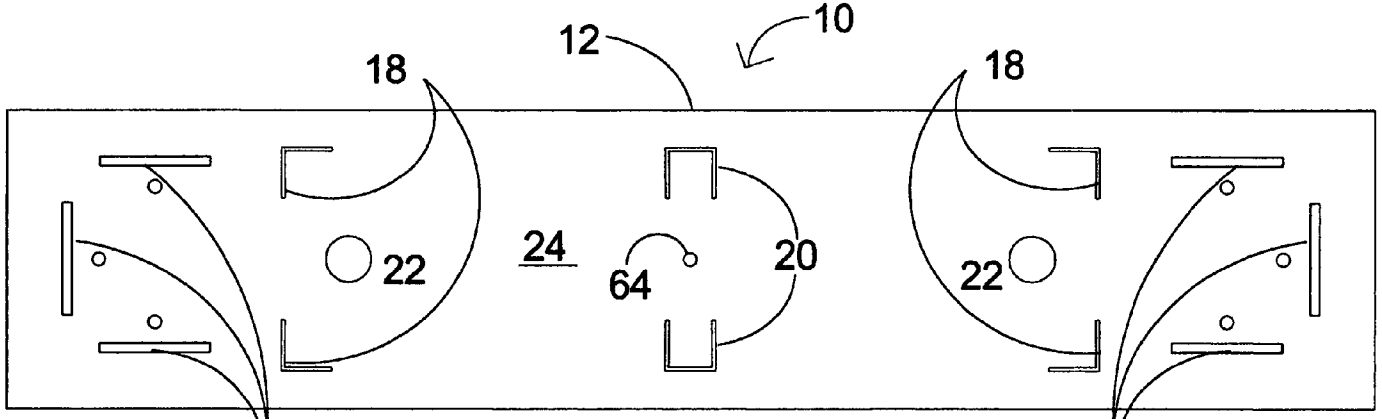
FIGS. 1*a* and 1*b* illustrate further construction details of the rectangular member of FIG. 1.
Figure 1B:
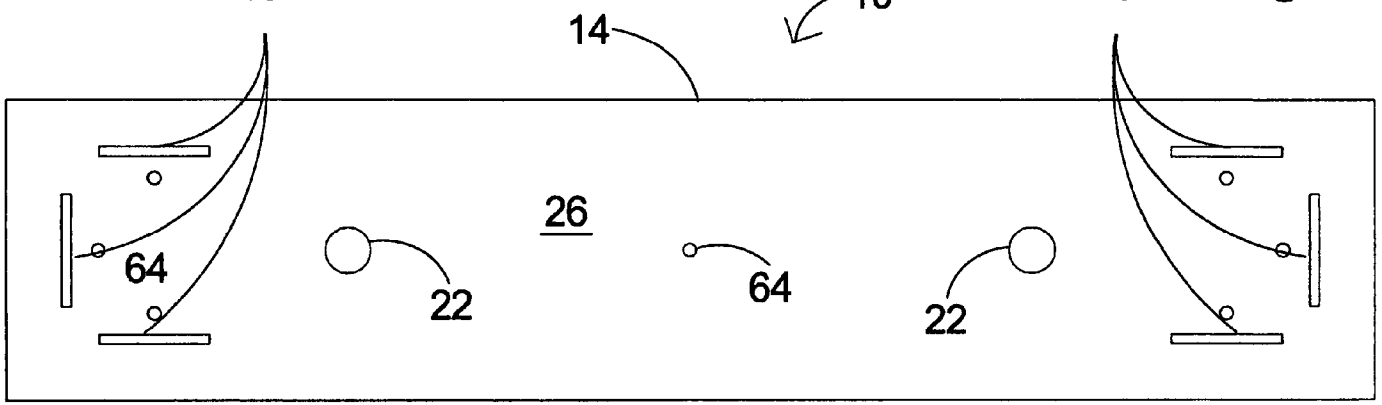

FIG. 1*a* shows a planar view of one side 24 of an assembled assembly plate 10, and FIG. 1*b* shows the opposite side 26 of the assembled assembly plate 10. As stated, when an elongated L shaped beam member is passed through slots 18, 20, they will abut stop plate 14 and be prevented from passing through assembly plate 10 by stop plate 14.

Figure 2:
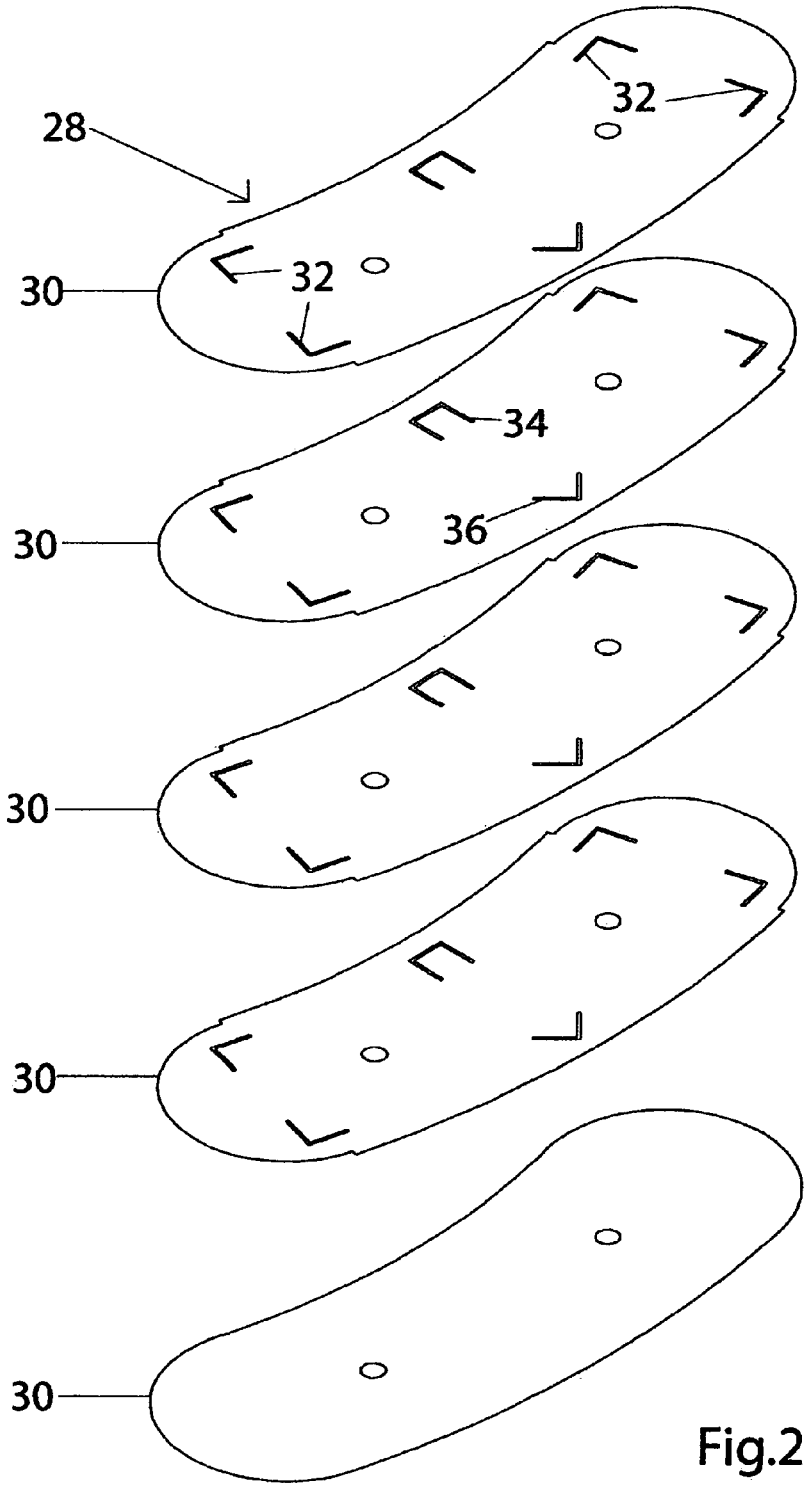
FIG. 2 illustrates construction details of a kidney-shaped structural member of my new disposable display booth system.

FIG. 2 shows an exploded view of a kidney-shaped structural assembly plate 28 of the instant invention that is used to form a kidney-shaped ancillary booth structure. The size of these assembly plates will very, but in this example the unit is about 50" long, 13" wide and 1.25" thick. Layers 30, which as noted may be 5 layers of corrugated cardboard and glued together to form assembly plate 28, are provided with sets of end slots 32, with a U-shaped slot 34 and L-shaped slot 36. Slots 34 and 36 may be positioned so that there is equal spacing from slots 34 to sets of end slots 32. A stop plate 38 is provided to prevent connecting members from passing through assembly plate 28 as described for member 10. All respective slots in the layers are in communicating relation as described for assembly plate 10.

Figure 2A:
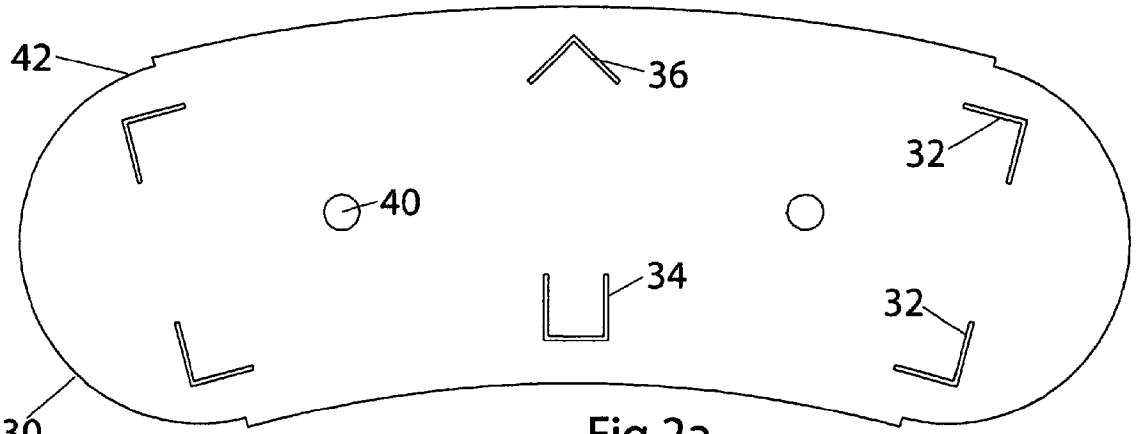
FIGS. 2*a* and 2*b* illustrate further construction details of the structural member of FIG. 2.
Figure 2B:
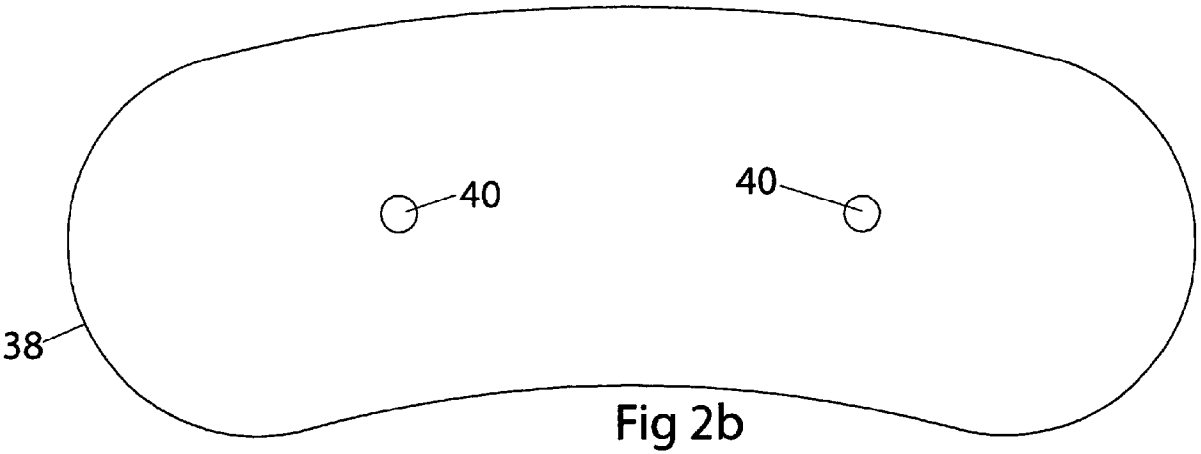

FIG. 2*a* illustrates a side of assembly plate 28 including one of layers 30, and the arrangement of L-shaped slots 32 and 36 and U-shaped slots 34. FIG. 2*b* shows the opposite side including stop plate 38. Here, stop plate 38 is not provided with any slots. Openings 40 are used during fabrication of assembly plate 28 in order to register the respective slots and openings together when the respective layers of assembly plate 28 are glued. A region or portion 42 at each end of layers 30 is recessed with respect to end plates 38, for reasons that will become apparent hereafter.

Figure 3:
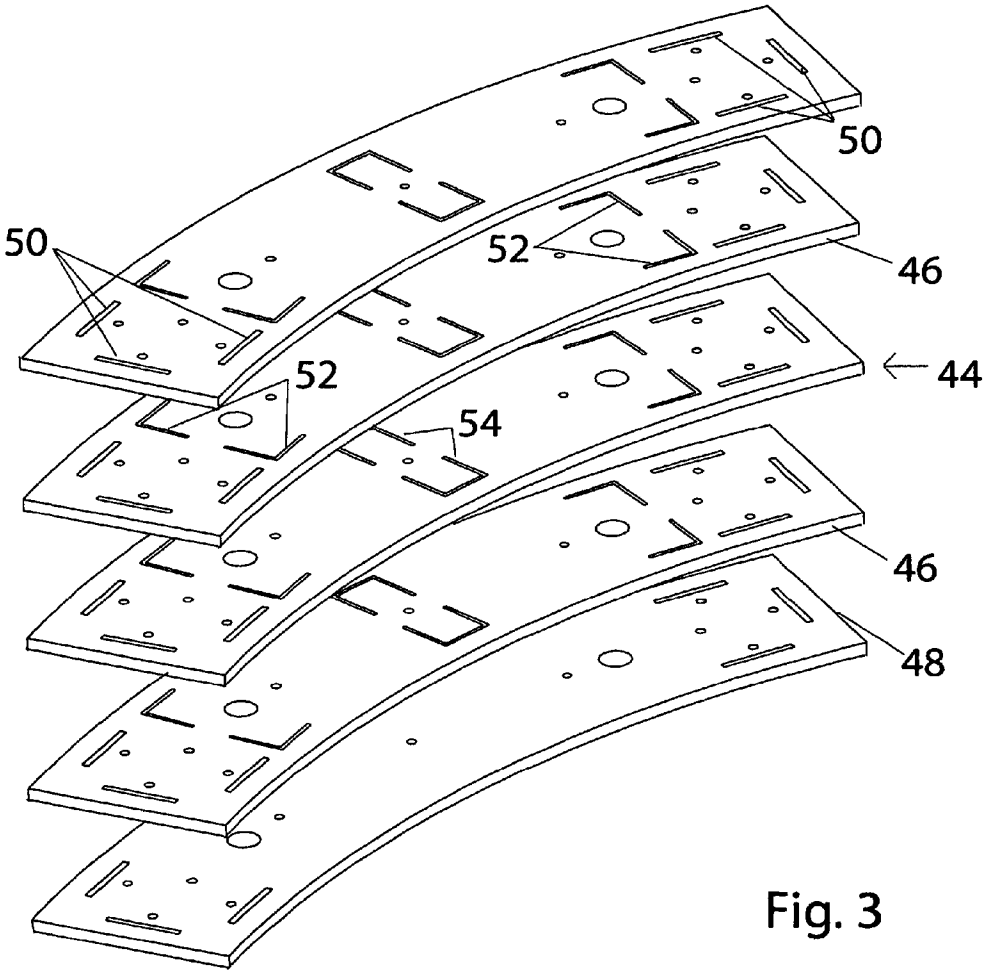
FIG. 3 illustrates construction details of a semi-circular structural member of my new disposable display booth system.

FIG. 3 shows an exploded view of a semi-circular assembly plate 44 having layers 46, typically 5 layers of corrugated cardboard, and an end plate 48, the layers 46 and end plate 48 glued together as described above. Assembly plate 44 is used to form a curved booth portion. As shown, layers 46 each are provided with sets of end slots 50, with sets of L-shaped slots 52 inboard slots 50. A set of U-shaped slots 54 are generally centrally located in layers 46. As described, a spacing between U-shaped slots 54 and L-shaped slots 52 may be selected so that there is an equal spacing between U-shaped slots 54 and sets of L-shaped slots 52.

Figure 3A:
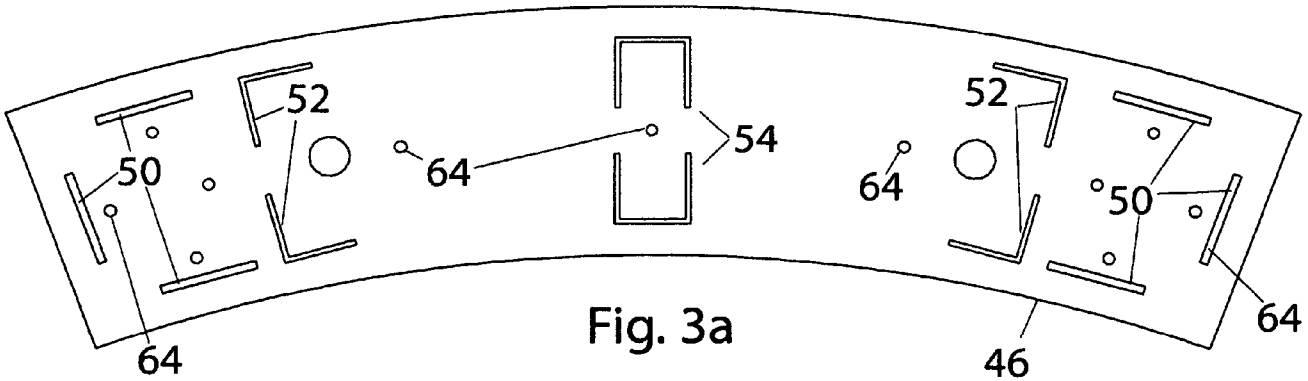
FIGS. 3*a* and 3*b* illustrate further construction details of the structural member of FIG. 3.
Figure 3B:
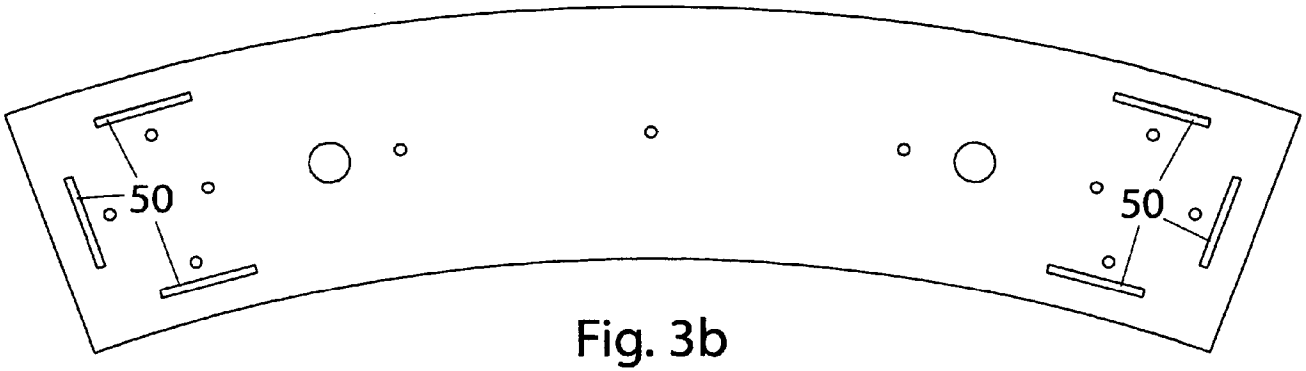

FIG. 3*a* illustrates a planar view of one side of assembly plate 44 including a layer 46 with its corresponding sets of slots 50, 52 and 54. FIG. 3*b* illustrates the opposite side including a stop plate 48 that is only provided with sets of slots 50.

Figure 4:
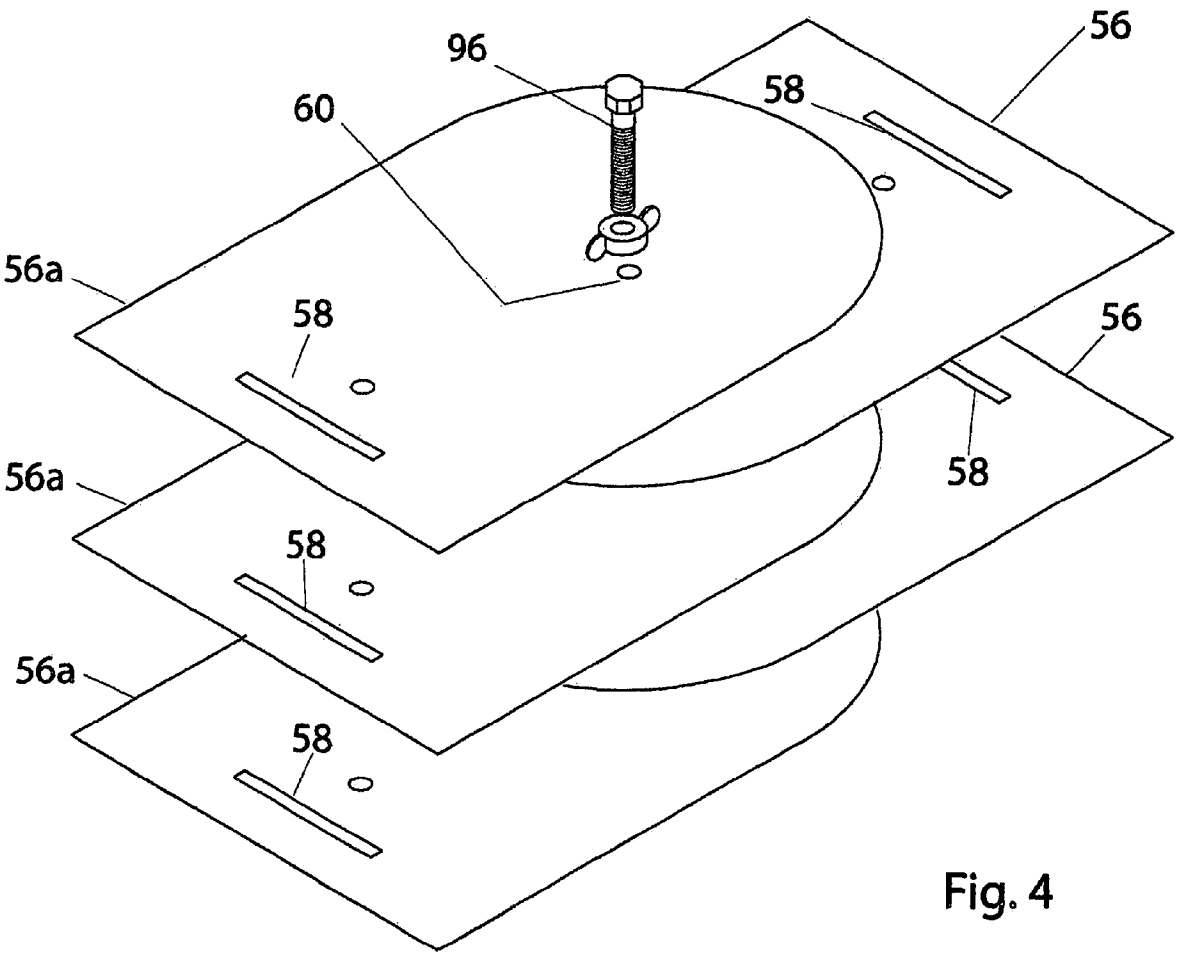
FIG. 4 illustrates construction details of a pivoting joint of my new disposable booth system.
Figure 4A:
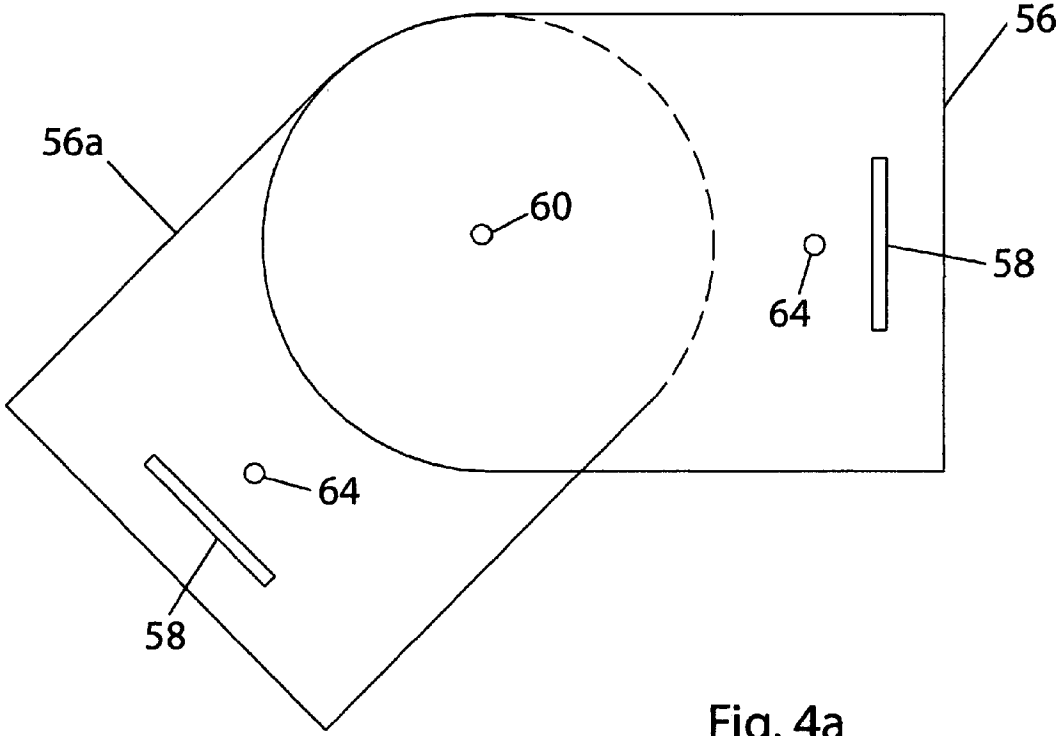
FIG. 4*a* illustrates further details of the pivoting joint of FIG. 4.

FIG. 4 illustrates identical structural members 56, 56*a* that are used to form pivoting joints for attachment to ends of various booth portions in order to position adjacent booth portions at any angle with respect to each other. Members 56, 56*a* are each a single layer of corrugated cardboard, and interleaved as shown to form a pivoting joint. Each layer is provided with a slots 58 that is used to connect to other assembly plates and discrete booth portions of the instant invention. An opening 60 is provided, in each cardboard layer for receiving a pin, fastener or other axial member 96, which as shown may be a nylon bolt secured on the opposite side by a wingnut, to serve as an axle about which members 56, 56*a* pivot. When assembled, and ends of members 56, 56*a* attached to other respective booth portions, a joint is formed that may be oriented at any angle, an example of which being shown in FIG. 4*a*.

A rounded end member 65 (FIG. 7*a*) may be formed by laminating 5 layers of the structural members 56, 56*a* (FIG. 4) together. As such, only a single die is needed to manufacture both the pivoting joint and rounded end members 61. In end member 61, slot 58 in each of the layers is used for attachment to any of the other booth portions described herein, as will be explained, and a rounded edge 65 is provided with one portion of hook-and-loop tape 67 for attachment to a covering provided with the other portion of hook-and-loop tape, and which may be stretched between the rounded ends and other booth portions, and provides a finished look to the booth. Such a laminated rounded end member 61 and associated hook-and-loop tape 63 is shown in FIG. 7*a*.

Figure 5:
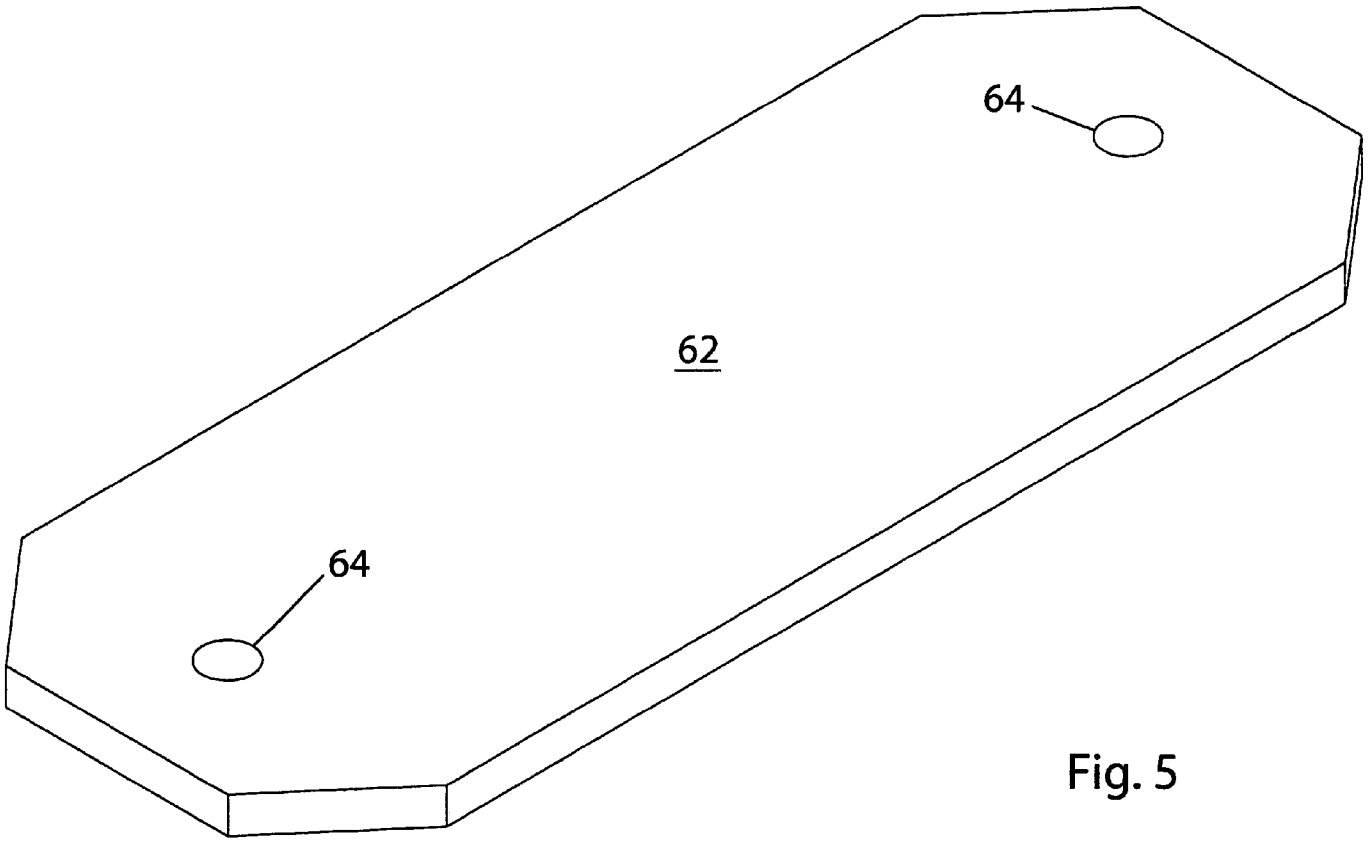
FIG. 5 illustrates construction of a gusset of my new disposable booth system.

FIG. 5 illustrates a gusset or connection member 62, and which may be fabricated of one or more layers of corrugated cardboard, or sheet plastic, such as polyvinyl chloride (PVC) on the order of perhaps 0.125-0.25 inches or so, or any other suitable thickness to perform the intended function. This member can be made in different sizes, but in this example the piece is 8" long, 3" wide and ¼" thick. Members 62 are attached at various locations on the other structural members by fasteners that extend through openings 64 in members 62 and corresponding openings 64 in the other structural members, as will be further explained. These openings 64, when not used in conjunction with gussets 62, may also be used to secure lights and other fixtures to the structural members making up a display booth.

Figure 6:
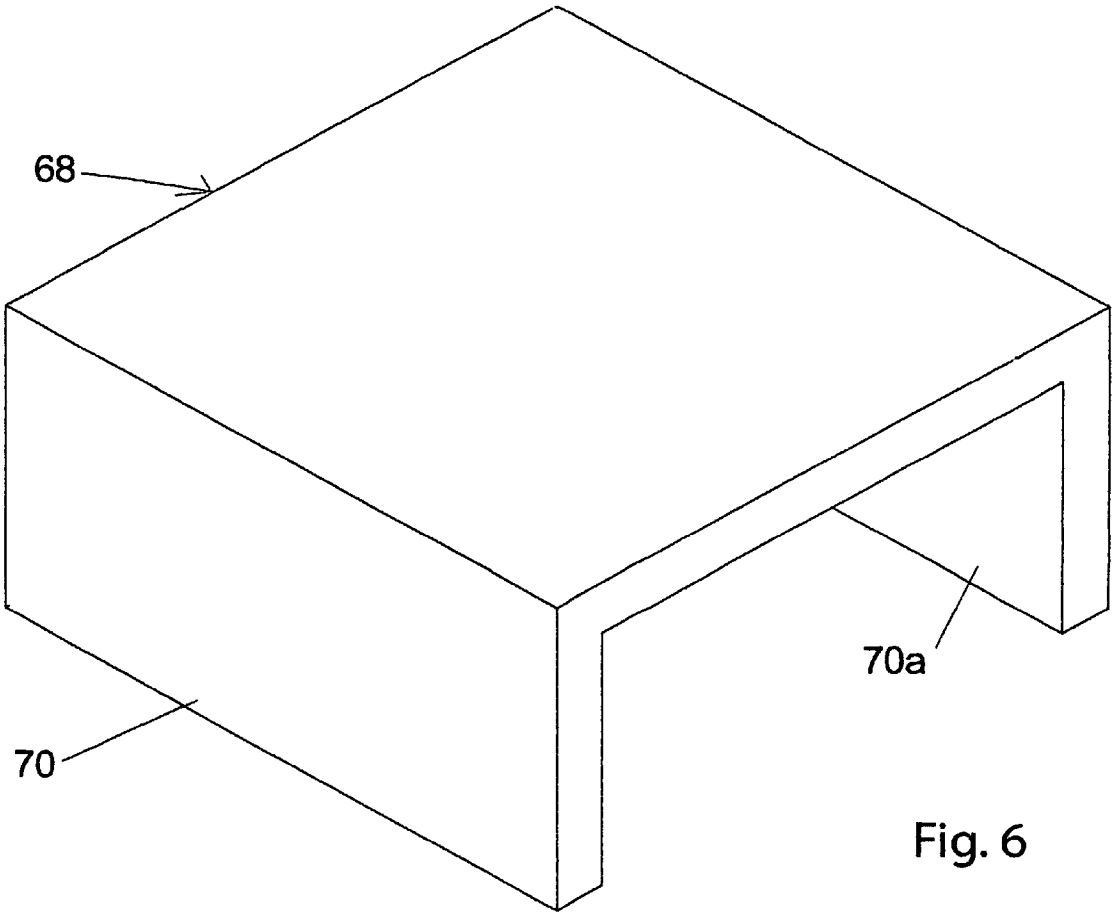
FIG. 6 illustrates a connector of my new disposable booth system.

FIG. 6 illustrates a U-shaped connector 68, which may be fabricated of PVC, and which is used to temporarily connect the various top assembly plates and bottom assembly plates of booth portions together to form frame portions of a tradeshow booth. Connector 68 is provided with downwardly depending legs 70, 70*a* that fit into a selected slot of sets of slots 16 (FIG. 1), 50 (FIG. 3) and 58 (FIG. 4). As such, leg 70 is pushed into the selected slot of one top assembly plate or bottom assembly plate of a booth portion, and leg 70*a* is pushed into a selected slot of an adjacent top assembly plate or bottom assembly plate of an adjacent booth portion, locking the two booth portions together. As should be apparent, sets of slots 16, 50 and 58 allow for orienting of adjacent booth portions at orthogonal angles, although slots oriented in different directions may also be provided. Also, where booth portions are to be connected at an angle other than an orthogonal angle, a pivoting joint as shown in FIG. 4 may be employed, one side of the joint connected to one of the top or bottom assembly plate of a booth portion and the other side of the joint connected to the adjacent respective top plate or bottom assembly plate of the adjacent booth portion. While connector 68 is disclosed as being made from PVC in order to easily recycle the entire display booth, it should be apparent that other materials may be used for this connector. For instance, where the connectors are not discarded or recycled, connectors 68 may be made of a more durable material than PVC, such as a metal such as aluminum. Here, the connectors may easily and inexpensively be constructed as an extrusion that is cut into lengths to form the connectors. On the other hand, to facilitate recycling, these connectors may be constructed of pressed and glued paper, cardboard, bamboo or the like.

Most exhibition halls require that display booths be constructed of fire resistant or retardant materials. In order to meet this requirement, components of Applicants booth are treated with a non-toxic fire retardant known as FSP P-3000 Paper-Shield, which is rated a Class "B" flame retardant.

Figure 7:
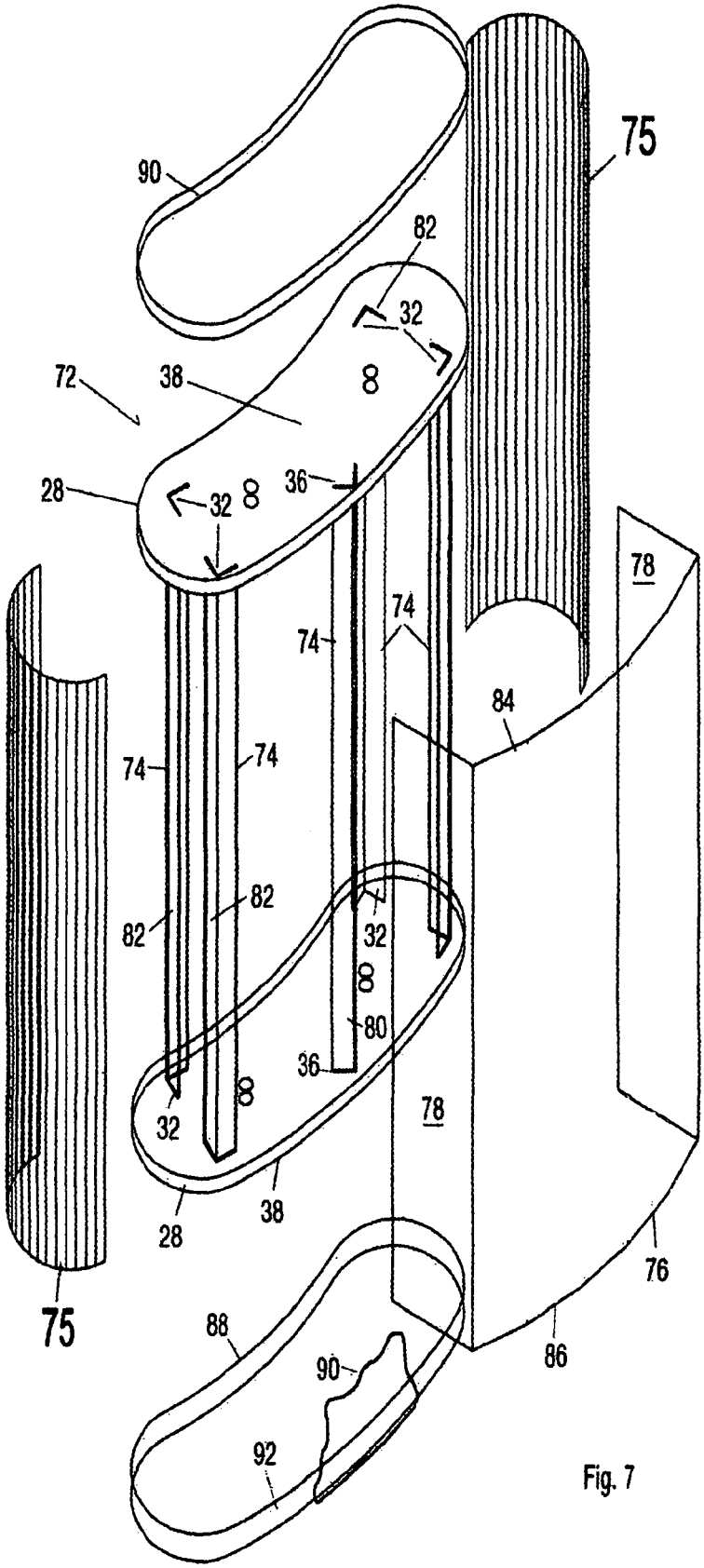
FIG. 7 illustrates construction of a podium, reception desk or the like for my new disposable booth system.
Figure 7A:
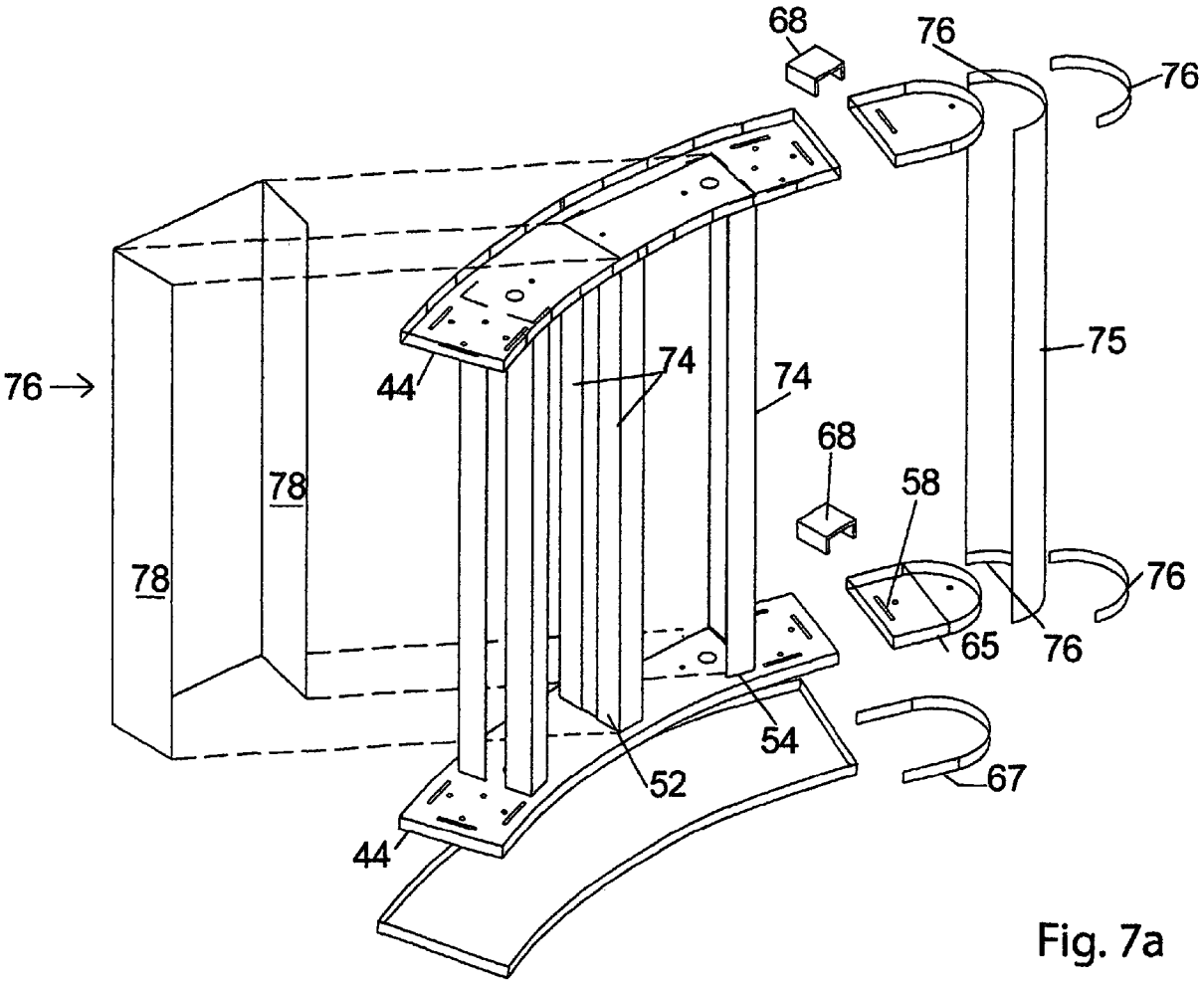
FIG. 7*a* illustrates construction details of a curved booth portion of my new disposable booth system.

FIG. 7 illustrates an exploded view of a booth portion constructed to form a podium, table, stand, pedestal, reception desk, table top display or the like as an ancillary component for a display booth system in accordance with the instant invention. Stand 72 is constructed using a top assembly plate and bottom assembly plate 28 (FIGS. 2, 2*a*, 2*b*). For connecting assembly plates 28 together, L-shaped beam members 74 of equal length (in this example the unit are about 45" long) are inserted into respective slots 32, 36. In this construct, assembly plates 28 are oriented so that stop plate 38 for the lower or bottom assembly plate rests on a floor or other surface, and stop plate 38 for the top or upper assembly plate is facing upward. If desired, a material having a finished surface may be attached to the upper assembly plate 28, and which may be a laminate, plastic or another synthetic or natural material. Significantly, one inexpensive, readily available product that has been found particularly suitable for L-shaped beam members 74 for this and other applications of the invention are edge protectors used to protect edges of other products during shipping, and which are commonly available. Such edge protectors are fabricated of compressed paper and glue, are 2"×2" in width, are easily recycled and are cut to any length as needed, depending on the application.

For stabilizing and lending rigidity to stand 72, sides 75 of a sheet material are provided, and which may be creased multiple times as shown in order to be fitted into recessed portions 42 (FIG. 2*a*) of assembly plates 28. Hook-and-loop tape is used to temporarily attach sides 75 into recessed portions 42. For facilitating recycling of the stand, sides 75 may be fabricated of cardboard, such as the double walled E-flute cardboard described earlier, and creased in increments as shown for being contoured to the rounded shape of ends of assembly plates 28, or constructed of a relatively thin sheet plastic that may easily bent around the ends of assembly plates 28 and attached in place with hook-and-loop tape respectively attached, as by glue, to top and bottom portions of sides 75 and the respective recesses in members 28. A front sheet or diaphragm of cardboard 76 having opposed side portions 78 folded as shown is fitted between upper and lower members 28 so that the side portions 78 of diaphragm 76 are wedged between L-shaped members 74 with a plane of side portions 78 being against an interior side of sides 82 of L-shaped beam members 74. A front of diaphragm 76 passes in front of front edge 80 of member 74 in slot 36. With this construction, and with accurately cut portions of sheet 76, sheet 76 is tightly wedged between and against L-shaped members 74, which lends considerable strength and rigidity to the stand. As noted, sides 75 also provide strength and rigidity, and also have a diaphragm structure, i.e. constructed of a thin, rigid material, such as the double walled E-flute cardboard as earlier described. A back area of stand 72 opposed from front diaphragm 76 may be left open for storage of small articles, sales brochures and literature, personal items, and the like, or closed by a covering in conjunction with hook-and-loop tape.

For covering stand 72 with a decorative or advertising covering, one portion 88, 92 of hook-and-loop tape may be glued or otherwise attached to edges of lower and upper members 28. A fitted sheet material 90 (shown broken away), which may be a fabric or plastic sheet and being printed with the advertising material or left plain, is provided with the other portion 92 of hook-and-loop tape. With this construction, the sheet is affixed in place by the hook-and-loop tape, giving the stand a finished look. As should be apparent, other methods may be used for attaching sheet 90 in place, such as stapling or using other fasteners, or gluing with a glue such as hot melt glue. Edging may be applied over the staples, fasteners or glue to provide a finished look. Another way of attaching a fabric material for a finished look would be to sew a continuous covering with one end closed (like a pillow case) and then pulling the fabric case over the top and fastening or zipping the bottom closed.

A stand using the construction of the instant invention is surprisingly strong. In a loading test, it was found that such a stand failed at a load of 770 pounds evenly distributed across a top thereof.

Figure 8:
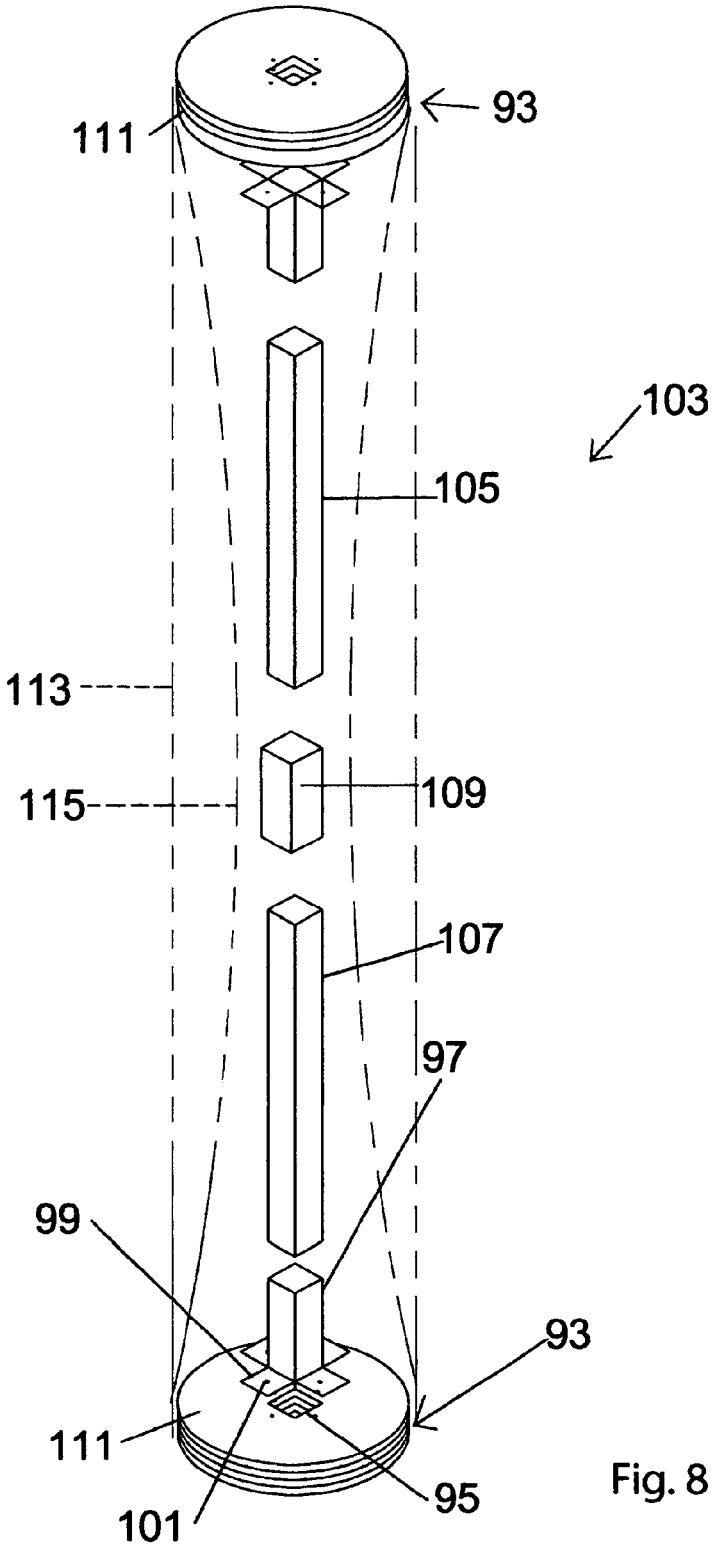
FIG. 8 illustrates construction details of a column structure of my new disposable booth system.

Another ancillary structure, a column of the instant invention, is shown in FIG. 8. Here, top and bottom assembly plates 93 are made circular in shape but could also take on other shapes such as ovals, squares, and the like, and constructed of 5 laminated layers of fluted cardboard as described above. In this example the circle has a radius of 12". Centrally provided in interior surfaces of each of the circular assembly plates are communicating openings 95 that each receive a fastener. A square receptacle 97, which may be of the described cardboard, is provided with flanges or ears 99, and which may be constructed simply by cutting each or the corners of the receptacle and outwardly folding the sides, forming orthogonally positioned ears 99. A square recess extending partially through assembly plates 93 is provided, and which communicates with receptacle 97. Ears 99 are each provided with openings 101 through which a fastener may be passed, and which also engages openings 95 in circular assembly plates members 93, connecting square receptacle 97 to the interior surface of circular assembly plates 93. A column 103 square in cross section and dimensioned to frictionally engage in telescoping relation receptacles 97 and the communicating recess is used to connect the so-assembled upper and lower circular members 93 together. Column 103 may be constructed in 3 sections, an upper section 105 and a lower section 107 frictionally coupled together by a square-in-cross section telescoping connecting member 109, which is cut from the same stock as receptacle 97. With this construction, the column may be fitted into the aforementioned boxes, although in some instances the circular tops may need a different size of packaging box, depending on the diameter of these tops. One portion of hook-and-loop tape 111 is provided around edges of each of circular assembly plates 93, and a cylindrical fitted covering having the other portion of hook-and-loop tape at a top and bottom thereof is provided. Two such coverings are provided, one that is relatively non-elastic and which when fitted in place provides the look of a straight column, as shown by dashed lines 113. The other covering is fabricated of an elastic material, such as Spandex™, and when fitted in place provides the look of a concave column, as shown by dashed lines 115. In both instances, the covering is stretched relatively tight so the covering is not wrinkled or sagging.

One or more diaphragms 75, 76 as described above with respect to FIG. 7 are used in conjunction with the other booth portions, for strengthening the entire booth when it is assembled. For instance, in the circular booth portion of FIG. 7*a*, a diaphragm constructed as described may be positioned between the L-shaped members 74 in slots 52 and 54. In this instance, only one diaphragm may be used between upper and lower assembly plates 44 due to the L-shaped members 74 in sets of slots 54 being open either to the left or right to accommodate sides 78 (FIG. 7) of the diaphragm. It is reiterated here that diaphragms 76 are merely wedged in place between L-shaped members 74 without need of using fasteners of any kind.

Ends of the booth portions of FIG. 7*a* and other booth portions may be finished by using rounded end portions 65 connected to the booth portion using connectors 68. Hook-and-loop tape 67 mounted to the rounded portion provides a means for attaching a sheet cover to the booth portion or assembly of booth portions.

Figure 9:
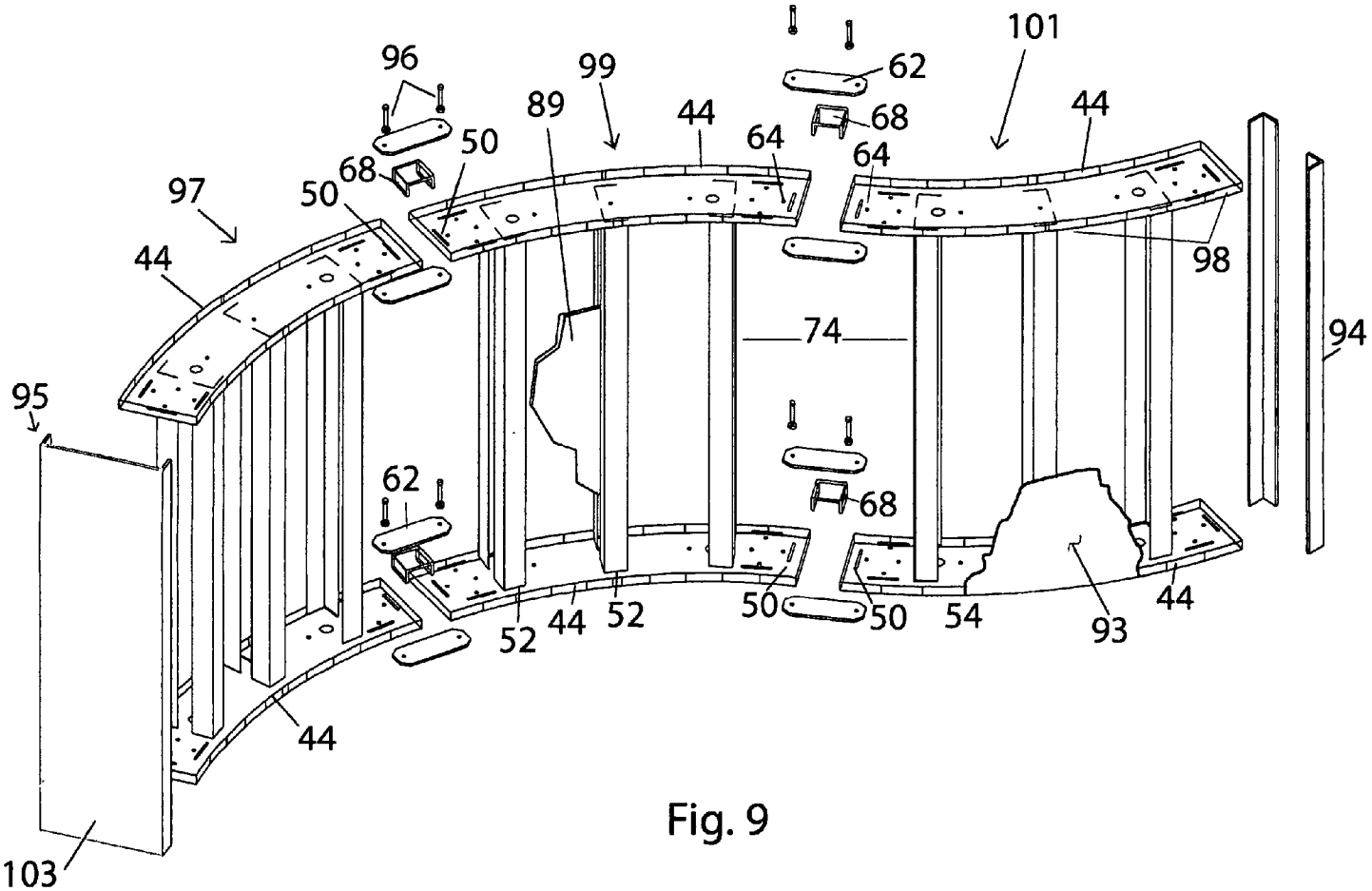
FIG. 9 illustrates, by way of example, construction details of a portion of my new disposable booth system.

In another example of construction of the instant invention, reference is made to the partially exploded view of FIG. 9. Here, a serpentine construct made up of booth portions 97, 99 and 101 is shown that may be positioned across a front or rear portion of a display booth, and which is constructed of top and bottom assembly plates 44 as shown in FIGS. 3, 3*a* and 3*b*. L-shaped pressed paper and glue beam members 74 as described above are mounted in L-shaped slots 52 (FIG. 3), and in U-shaped slots 54. As should be apparent, the beam members 74 may be oriented in two positions in the U-shaped slots 54, as desired by the builder. Here, a particular orientation may be selected for strength, or other factors such as whether a back area is to be left open or not. As noted above, light or other fixtures may be mounted along a top of the arrangement using openings 64 in each of assembly plates 44. Each of the booth portions 97, 99 and 101 are connected together at their upper and lower assembly plates 44 using a U-shaped connector 68 inserted into end slots 50 of adjacent assembly plates 44. For securely holding connectors 68 in place, a gusset 62 (FIG. 5) may be affixed over a respective connector 68 using fasteners 96 that extend through openings 64 in the gussets and openings 64 in opposed ends of assembly plates 44. Significantly, for recycling, fasteners 96 may be a bolt and wingnut made of a plastic material, such as Nylon™, and which are readily available through hardware suppliers. As noted, such construction facilitates disposability and recycling, and requires no tools whatsoever for assembly.

For providing a finished look, the serpentine construct of FIG. 9 may have one portion of hook-and-loop tape mounted across upper and lower edges of members 44, and a sheet material 93 (shown cut away) cut and sewed as desired and having the other portion of hook-and-loop tape mounted thereto. Such material typically would have advertising and promotional material printed thereon, and may be an anti-static fabric, a paper, plastic or even elastic material such as Spandex™ or other similar material. The material is then stretched across a front of construct 95 and affixed in place by engagement of the respective portions of hook-and-loop tape. If desired, and as noted, an upper surface of assembly plates 44 may be finished by gluing a laminate or a plastic layer thereto.

Figure 4B:
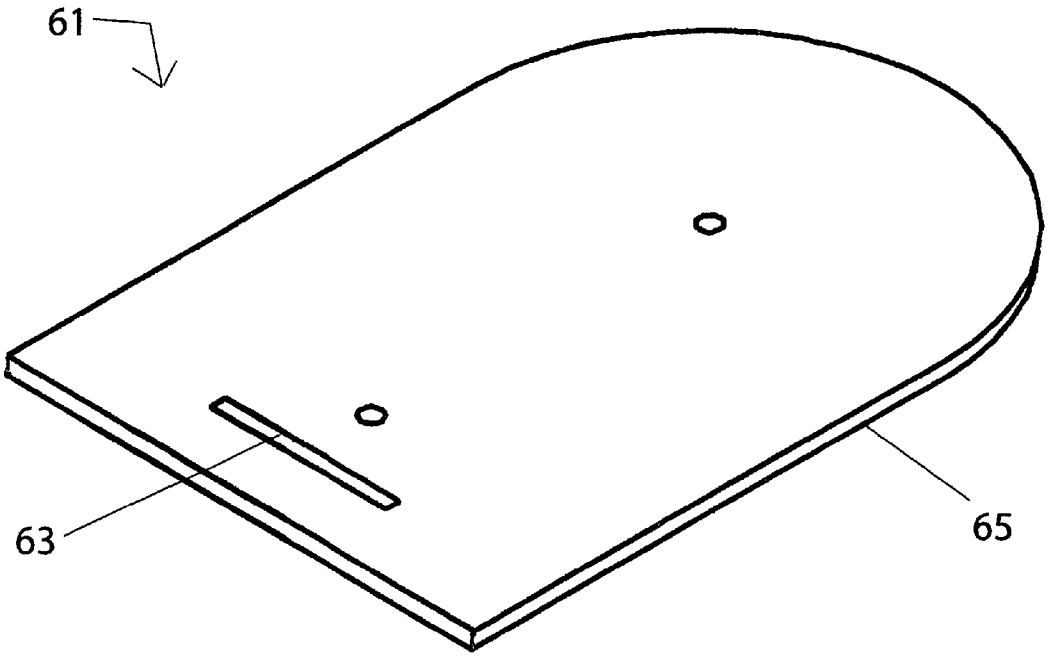
FIG. 4*b* illustrates a rounded end portion that may be atached to an end of a booth wall or used to form the pivoting joint of FIG. 4*a*.

Ends of the serpentine construct, and other portions of a tradeshow booth of the instant invention may be finished using one of several designs. In a first design, L-shaped members 94 are attached to ends of a semicircular member using hook-and-loop tape, with a covering in turn attached to outer surfaces of the L-shaped members. In a second design, a rounded end portion as shown in FIG. 4*b* and described above is connected using connectors 68 to ends of upper and lower semicircular portions, and a covering that is attached to the construct using hook-and-loop tape as described above stretched over the rounded end members. In a third design 105 as shown on FIG. 9, a folded section of fluted cardboard is attached between upper and lower ends of end semicircular members using hook-and-loop tape, and a covering that is stretched taut over the serpentine structure also being stretched over the end cardboard portion and attached to a rear edge thereof using hook-and-loop tape.

In some instances, panels of an acoustic deadening material 89 (FIG. 9) may be inserted in spaces between members 74, for providing soundproofing.

Figure 10:
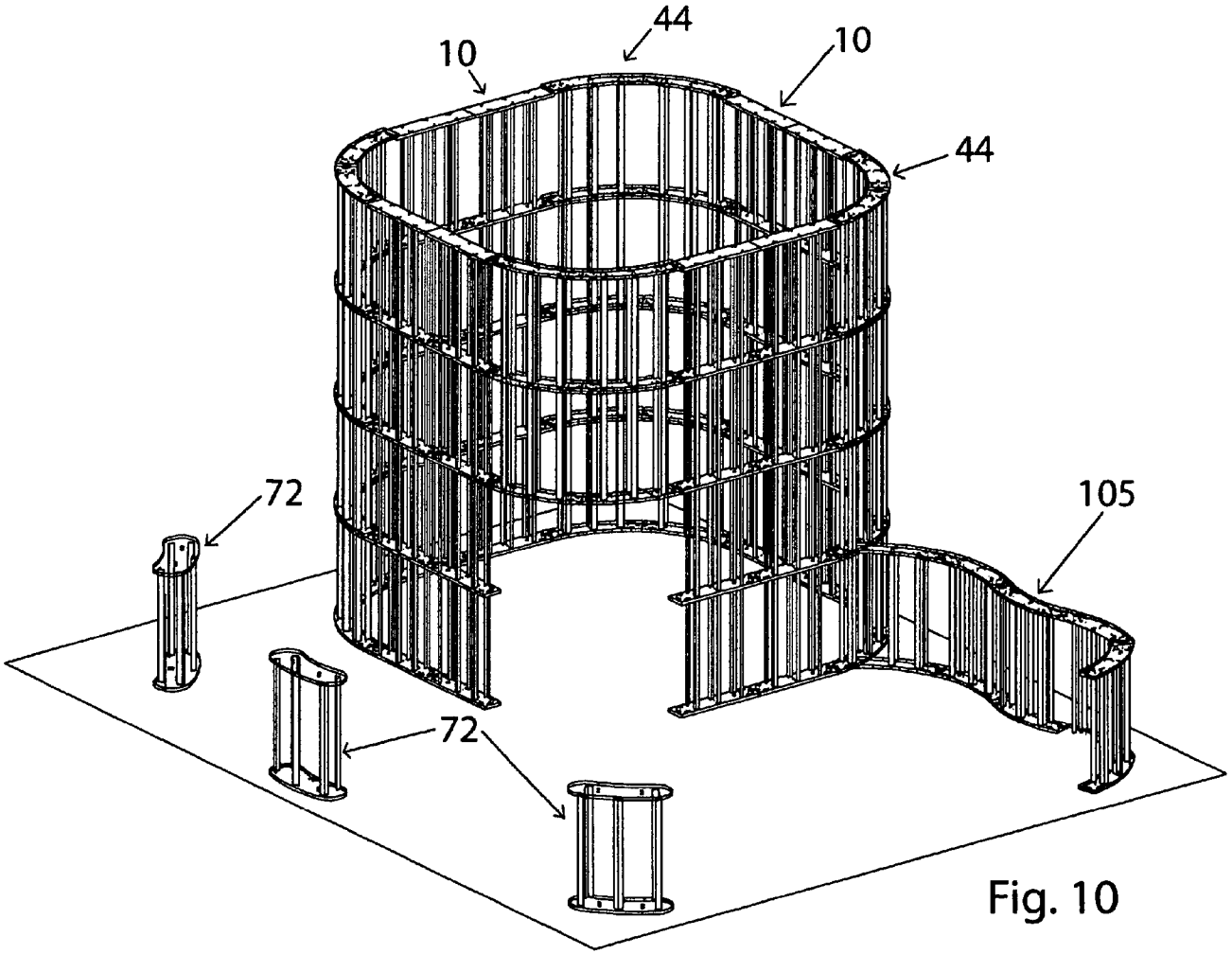
FIG. 10 illustrates a tradeshow booth structure using the booth portions of my new disposable booth system.

FIG. 10, by way of example only, shows a framework of a tradeshow booth of the present invention. Here, stands or reception podiums 72 as shown in FIG. 7 are provided around the booth area. A serpentine form 105 as shown in FIG. 9 is provided along one side of the booth, and straight booth portions 10 and curved booth portions 44 are shown connected together and in a stacked configuration. As described, coverings (shown elsewhere) having decorative and/or advertising material printed thereon are attached to and cover most or all of at least the exteriors of the booth portions. A tradeshow booth constructed as shown of my new booth portions and coverings has a footprint of 30 feet by 30 feet.

Figure 11:
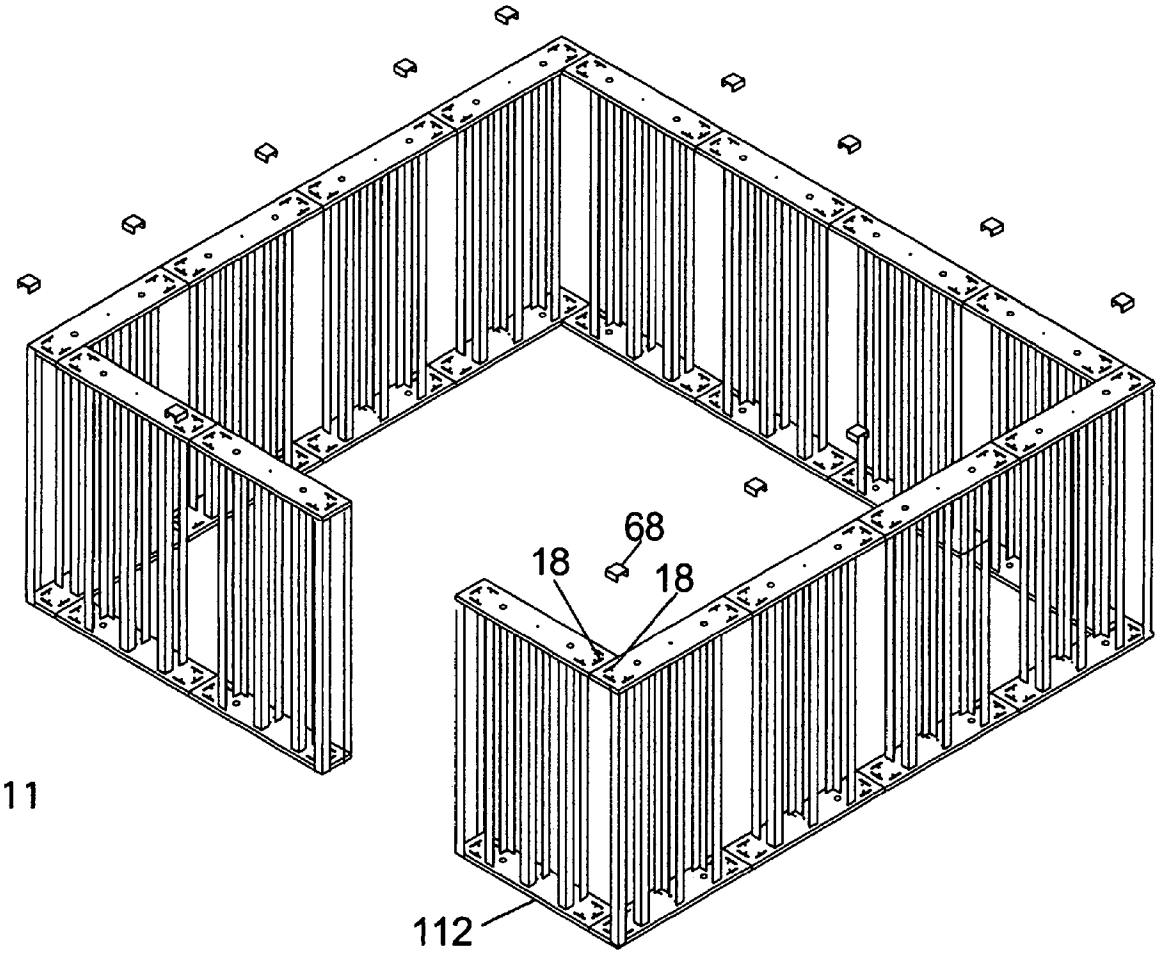
FIG. 11 illustrates one embodiment of a cubicle constructed using a straight booth portion of my new disposable booth system.
Figure 12:
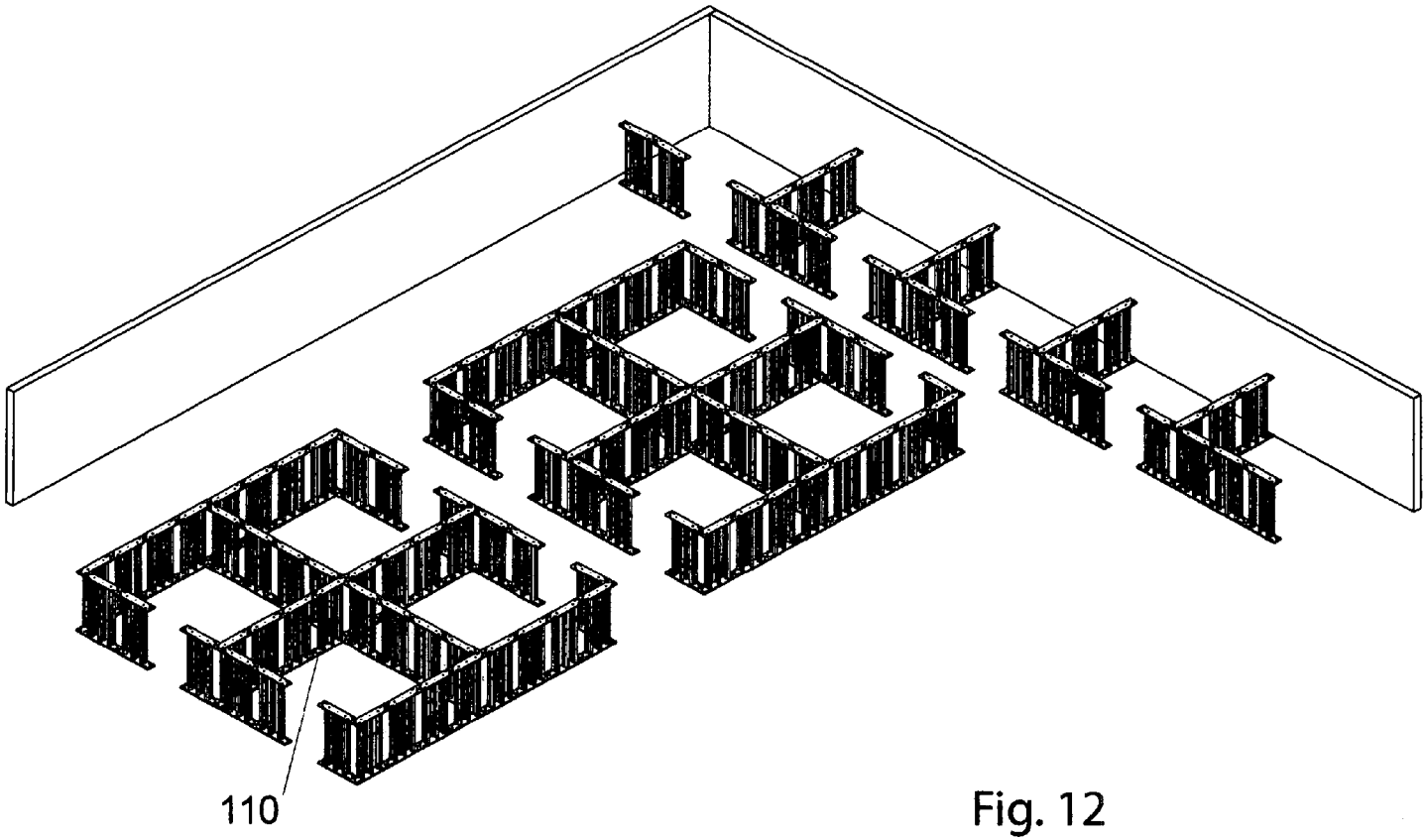
FIG. 12 illustrates a second embodiment of a cubicle array constructed using straight booth portions of my new disposable booth system.

In yet another ancillary component that may be used in conjunction with a tradeshow booth, or other applications, such as in an office setting, reference is made to FIGS. 11 and 12. Here, inexpensive cubicle dividers are constructed using straight booth portions as disclosed in FIGS. 1, 1*a*, 1*b*. Two types of cubicle dividers are contemplated, a T-shaped divider 110 as shown in FIG. 11, and an L-shaped divider 112 as shown in FIG. 11. T-shaped office dividers of the present invention may use two straight booth portions connected together at their respective slots 18 using connectors 68. The T portion 110 of the divider (FIG. 12) may be formed by ends of members 10 that form the top of the T connecting to slots 16 along opposed sides and ends of the leg portion of the T shape. Webs or diaphragms 76 as described for FIG. 7*a* of fluted 2-sided cardboard are closely fitted in place as described between the L-shaped beams, which lends strength to the divider. The L-shaped cubicle divider of the instant invention is constructed simply by adding upper and lower members 10 orthogonally to an end of one side of a wall formed by members 10. As stated, L-shaped beams are mounted in slots 18, 20, with diaphragms of fluted cardboard configured to be closely fitted between L-shaped beams in slots 18, 20. The entire structure is covered with a finishing fabric or printed graphics as explained above.

Having thus described my invention and the manner of its use, it should be apparent to those skilled in the relevant arts that incidental changes may be made thereto that fairly fall within the scope of the following appended claims, wherein

We claim:

1. A display comprising:

at least one wall comprising;

a plurality of discrete wall portions from which said at least one wall is constructed, each discrete wall portion of said plurality of discrete wall portions further comprising:

a plurality of assembly members, each of said assembly members constructed of a lightweight nonmetallic recyclable material, where said plurality of assembly members further comprises;

a bottom assembly plate having a periphery therearound, a top assembly plate having a periphery therearound, one or more connecting members temporarily and removably connected between said top plate and said bottom plate, said one or more connecting members comprising one or more rigid, thin diaphragms of said lightweight nonmetallic recyclable material, said one or more rigid, thin diaphragms temporarily and removably connected to and extending around or along at least a portion of said periphery of said top plate and around or along at least a portion of said periphery of said bottom plate, for providing rigidity and stability to each said wall portion, connectors for temporarily connecting said plurality of wall portions together to form said at least one wall of said display, a flexible sheet material having display graphics thereon, and covering at least a display region of said wall, for providing a smooth, wrinkle-free said display that is easily assembled and disassembled by hand without a need for tools.

2. A display as set forth in claim 1 wherein said lightweight nonmetallic recyclable material comprises sheets of cardboard.

3. A display as set forth in claim 1 wherein said lightweight nonmetallic recyclable material further comprises compressed paper.

4. A display as set forth in claim 1 wherein said lightweight nonmetallic recyclable material further comprises plastic.

5. A display as set forth in claim 1 wherein said lightweight nonmetallic recyclable material is fire retardant.

6. A display as set forth in claim 1 wherein said plurality of assembly members further comprises support members having a generally L-shape cross section, said support members fitted into respective generally L-shaped openings in said top assembly plate and said bottom assembly plate.

7. A tradeshow booth as set forth in claim 6 wherein said support members comprise compressed paper.

8. A display as set forth in claim 1 wherein a plurality of said wall portions are stacked and removably connected together using removable fasteners to form a framework of said display.

9. A display as set forth in claim 1 wherein said discrete wall portions are each provided with connection openings at opposite respective ends thereof, for receiving a connector of said connectors, whereby said connector is pushed by hand into said connection openings of adjacent booth portions positioned end-to-end, attaching said booth portions together without tools.

10. A display as set forth in claim 1 wherein said discrete wall portions further comprise straight wall portions for constructing a straight, planar wall, and curved wall portions for constructing curved walls.

11. A display as set forth in claim 1 further comprising:

a column further comprising;

a top assembly member of lightweight recyclable material, a bottom assembly member of lightweight recyclable material, said top assembly member and said bottom assembly member each having a periphery in a shape of a desired cross section of said column, a support of said recyclable material extending between said top assembly member and said bottom assembly member, a cover comprising a lightweight, flexible sheet material removably attached to said periphery of said top assembly member and said periphery of said bottom assembly member, and stretched between said periphery of said top assembly member and said periphery of said bottom assembly member to form a column of a cross section defined by said periphery of said top assembly member and said periphery of said bottom assembly member.

12. A display as set forth in claim 1 further comprising easily attachable and detachable attachments for holding said flexible sheet material in stretched relation over said display region of said at least one framework wall.

13. A display as set forth in claim 1 wherein said lightweight nonmetallic recyclable material of said top plate and said bottom plate comprises a plurality of layers of cardboard that are bonded or attached together.

14. A display as set forth in claim 1 further comprising a pivoting member attached to respective ends of two adjacent said discrete wall portions using said connectors, for allowing pivoting motion between said two adjacent discrete wall portions.

15. A display as set forth in claim 1 wherein a plurality of said at least one framework wall are connected together to create a tradeshow booth, with said flexible sheet material having said graphics display fitted to walls of said tradeshow booth.

* * * * *